US007059018B2

(12) United States Patent
Koshikawa et al.

(10) Patent No.: US 7,059,018 B2
(45) Date of Patent: Jun. 13, 2006

(54) HINGE WITH CATCH

(75) Inventors: Shinichiro Koshikawa, Yokaichiba (JP); Kazuyoshi Oshima, Naruto-machi (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 137 days.

(21) Appl. No.: 10/470,697

(22) PCT Filed: Dec. 5, 2002

(86) PCT No.: PCT/JP02/12759

§ 371 (c)(1),
(2), (4) Date: Jul. 29, 2003

(87) PCT Pub. No.: WO03/048489

PCT Pub. Date: Jun. 12, 2003

(65) Prior Publication Data

US 2004/0068841 A1 Apr. 15, 2004

(30) Foreign Application Priority Data

Dec. 6, 2001 (JP) ..... 2001-372330

(51) Int. Cl.
*E05F 1/08* (2006.01)

(52) U.S. Cl. ..... 16/302; 16/297; 16/257; 16/286

(58) Field of Classification Search ..... 16/302, 16/297, 293, 294, 323, 327, 343, 346, 257, 16/263, 345, 286
See application file for complete search history.

(56) References Cited

U.S. PATENT DOCUMENTS

| | | | | |
|---|---|---|---|---|
| 2,605,926 | A * | 8/1952 | Casey | 220/840 |
| 2,734,222 | A * | 2/1956 | Kiba | 220/840 |
| 4,332,053 | A * | 6/1982 | Salice | 16/370 |
| 4,449,269 | A * | 5/1984 | Sundermeier et al. | 16/50 |
| 4,517,706 | A * | 5/1985 | Lautenschlager et al. | 16/238 |
| 4,543,686 | A * | 10/1985 | Rock et al. | 16/288 |
| 4,641,394 | A * | 2/1987 | Rock et al. | 16/302 |
| 5,937,479 | A * | 8/1999 | Ohshima et al. | 16/257 |
| 6,401,298 | B1 * | 6/2002 | Lenz | 16/335 |
| 6,523,224 | B1 | 2/2003 | Oshima et al. | |
| 6,543,088 | B1 | 4/2003 | Koshikawa | |
| 6,553,621 | B1 * | 4/2003 | Isele | 16/238 |
| 6,587,676 | B1 | 7/2003 | Oshima et al. | |
| 6,588,063 | B1 | 7/2003 | Oshima et al. | |
| 6,601,269 | B1 | 8/2003 | Oshima et al. | |

FOREIGN PATENT DOCUMENTS

| | | |
|---|---|---|
| JP | S61-197178 | 12/1986 |
| JP | 2-11576 | 3/1990 |
| JP | 5-1871 | 1/1993 |
| JP | 2652761 | 5/1997 |
| JP | 10-306644 | 11/1998 |
| JP | 10-315827 | 12/1998 |
| JP | 2000-17931 | 1/2000 |
| JP | 2000-54722 | 2/2000 |

* cited by examiner

*Primary Examiner*—Chuck Y. Mah
*Assistant Examiner*—Michael J. Kyle
(74) *Attorney, Agent, or Firm*—Brown & Michaels,PC

(57) ABSTRACT

A pair of projection elements 42, 42 are formed on the opposite sides of an inner link 4. Each projection element 42 is formed with a cutout recess 42*b*. A fitting shaft part 72*a*, which is formed on each end of an abutment shaft 72, is inserted into the cutout recess 42*b* through an open part thereof and turnably fitted to a bottom part of the cutout recess 42*b*. A second abutment part 71*c* of a coiled spring 71 is abutted with an enlarged-diameter part 72*b* of the abutment shaft 72. The abutment shaft 72 is biased towards the bottom side of the cutout recess 43*b* from the open part side thereof by the coiled spring 71.

6 Claims, 3 Drawing Sheets

HINGE WITH CATCH

TECHNICAL FIELD

This invention relates to a hinge for turnably connecting a skeleton of furniture and the like to a door for opening and closing an opening part of the skeleton, and more particularly to a hinge with catch which has a catch mechanism.

BACKGROUND ART

In general, a hinge of this type comprises a skeleton side attaching member fixed to the skeleton, a door side attaching member fixed to the door, an inner and an outer link for turnably connecting the door side attaching member to the skeleton side attaching member between a closed position and an open position, and a coiled spring for turnably biasing the door side attaching member through selected one of the inner and outer links. When the door is located in a position offset to the closed position side from a predetermined neutral position between the closed position and the open position, the coiled spring rotationally biases the door side attaching member towards the closed position side from the open position side. And when the door is located in a position offset to the open position side from the neutral position, the coiled spring rotationally biases the door side attaching member to the open position side from the closed position side.

One end of the coiled spring is abutted with the selected link in order to bias the link. Accordingly, the contact place of the selected link with respect to the coiled spring is rubbed by one end of the coiled spring when the link is turned in accordance with the turning motion of the door side attaching member. As a result, this link is liable to be worn quickly. In order to overcome this inconvenience, Japanese Utility Model Application Laid-Open Publication No. S61-197178 discloses a hinge including a pair of links, an abutment shaft turnably disposed at one of the links and a coiled spring one end of which is abutted with the abutment shaft. Owing to this arrangement, since the abutment shaft is in rolling contact with one end of the coiled spring, the abutment shaft can be prevented from wearing quickly.

The hinge which is described in the above Publication, however, has such a problem that much elaboration is required for mounting the abutment shaft on the selected link. That is, in the hinge described in the above Publication, in order to turnably mount the abutment shaft on the selected link a support hole is formed in each side of the selected link and the opposite ends of the abutment shaft are inserted in the respective support holes. With this arrangement, although the abutment shaft can be inserted in a selected one of the support holes comparatively easily, it is comparatively difficult to insert the abutment shaft, which is already inserted in the selected support hole, in the other support hole because the length of the abutment shaft is much greater than the outside diameter of the abutment shaft. For this reason, much elaboration is required to mount the abutment shaft on the selected link.

DISCLOSURE OF THE INVENTION

According to the present invention, there is provided, in order to solve the above problems, a hinge with catch comprising a skeleton side attaching member which can be attached to a skeleton; a door side attaching member which can be attached to a door; an inner and an outer link whose opposite ends are turnably connected to the skeleton side attaching member and the door side attaching member, respectively, so that the door side attaching member is turnably connected to the skeleton side attaching member between a closed position and an open position; an abutment member disposed generally in parallel relation to rotation axes of the inner and outer links and whose opposite ends are turnably supported by selected one of the inner and outer links; and biasing means for turnably biasing the door side attaching member through the abutment member and the selected link, by one end of the biasing means which is in abutment with the skeleton side attaching member and the other end thereof which is in abutment with an outer peripheral surface of the abutment member; wherein the selected link is provided with a pair of cutout grooves which are spacedly disposed in an axial direction of the abutment member, the pair of cutout grooves being formed such that opposite ends of the abutment member can be turnably inserted into the cutout grooves through open parts thereof until they reach bottom parts of the cutout grooves, the abutment member being pressed against the bottom parts of the cutout grooves by biasing force of the biasing means.

In this case, it is preferable that the cutout recesses are disposed between the rotation axes of the inner and outer links with respect to the skeleton side attaching member.

It is preferable that the selected link is provided at opposite sides thereof in the direction of the rotation axis with one pair of projection pieces which are placed in opposing relation in the direction of the axis of the abutment member, each of the projection elements is provided with the cutout recess, and the abutment member is provided at an outer peripheral surface thereof located between the pair of projection elements with a first and a second stopper for prohibiting axial movement of the abutment member, by the first and second stoppers which are in abutment with opposing surfaces of pair of the projection elements.

It is also preferable that the biasing means includes a coil part formed by spirally winding a rod material with a coil, and a first and a second abutment part projecting to the outside from opposite ends of the coil part, the coil part is externally inserted in a support shaft for turnably connecting one end of the inner link to the skeleton side attaching member or a support shaft for turnably connecting one end of the outer link to the skeleton side attaching member, and the first abutment part is abutted with the skeleton side attaching member while the second abutment part is abutted with the abutment member. It is particularly preferable that the coil part is externally inserted in the support shaft for turnably connecting the one end of the outer link to the skeleton side attaching member, and the cutout recesses are provided at the inner link.

BEST MODE FOR CARRYING OUT THE INVENTION

One embodiment of the present invention will be described hereinafter with reference to FIGS. 1 through 3.

Figure 1:
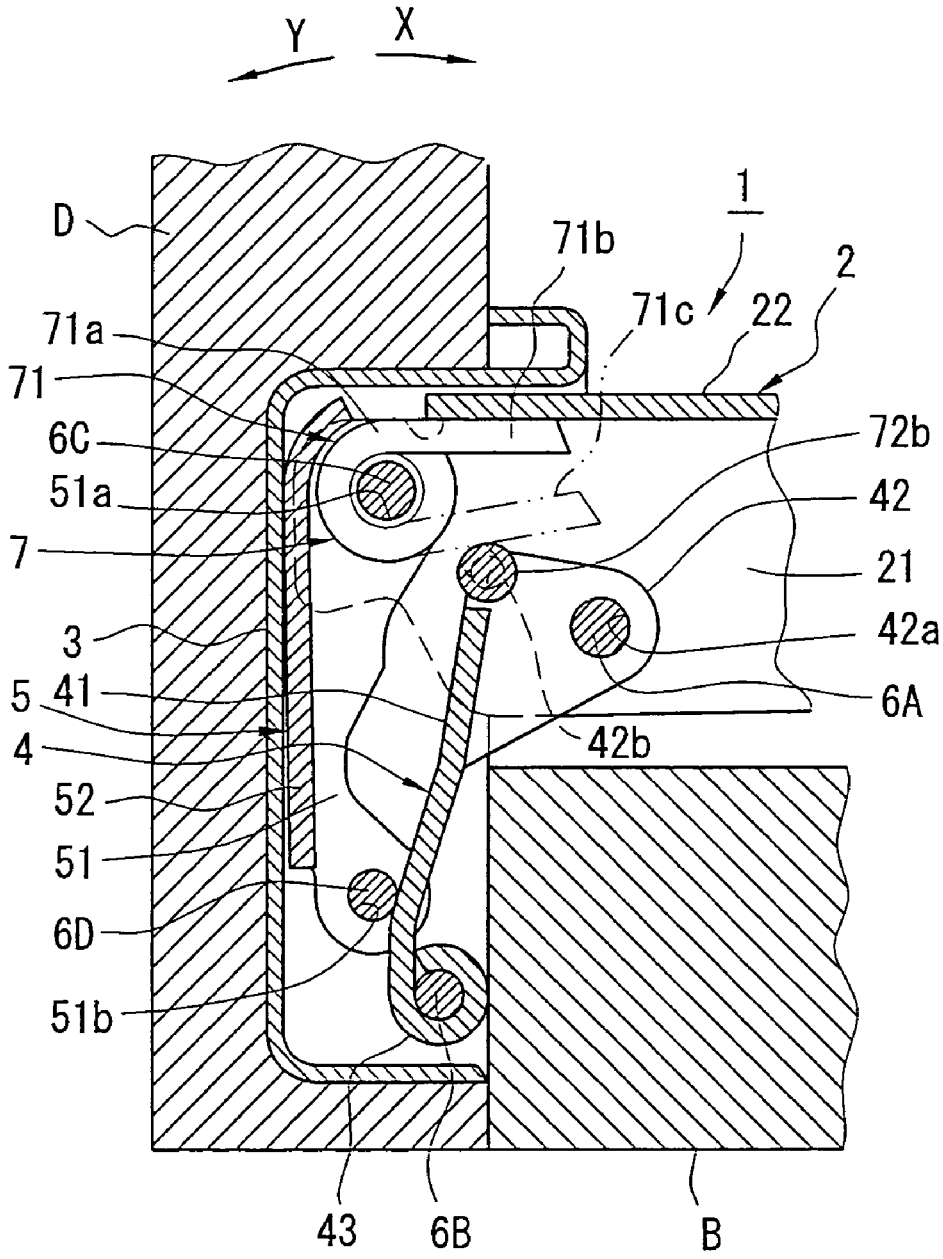
FIG. 1 is a plan sectional view showing an essential part of a skeleton and a door of furniture to which a hinge with catch according to the present invention is applied, in a state in which the door has been turned into a closed position.
Figure 2:
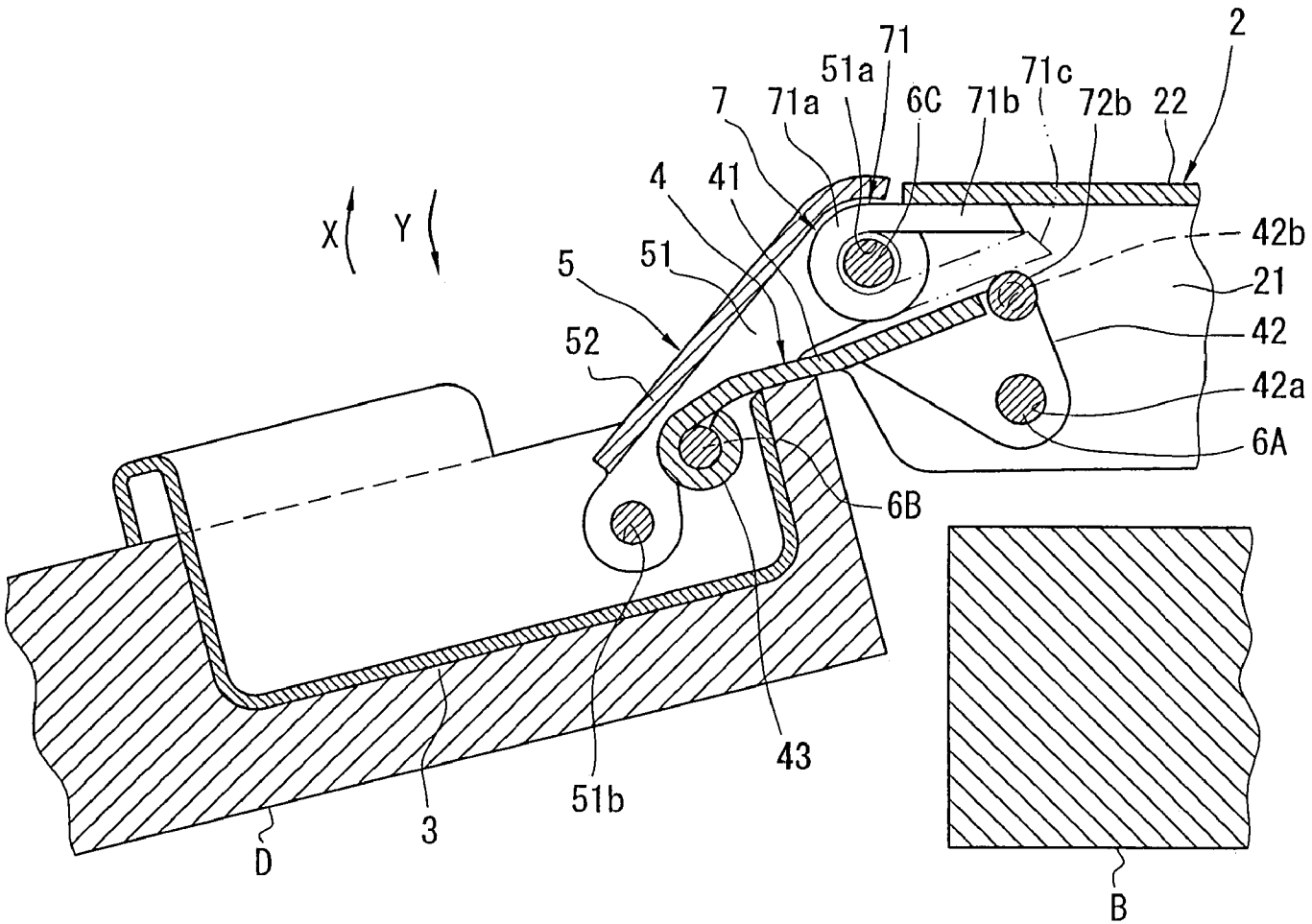
FIG. 2 is a plan sectional view showing the essential part, in a state in which the door has been turned into an open position.

FIGS. 1 and 2 are plan sectional views showing an essential part of furniture such as a wardrobe to which a hinge 1 with catch according to the present invention is applied. This furniture includes a skeleton B with an open front surface thereof and a door D for opening/closing the front opening part of the skeleton B. The door D is supported so as to be able to turningly open and close in the directions (horizontal direction) as indicated by arrows X and Y, on a side wall of the skeleton B through the hinge 1. The back surface of the door D is abutted against the front surface of the skeleton B, thereby the range of turning of the door D in the direction (closing direction) as indicated by the arrow X is restricted as shown in FIG. 1, and the rotational position of the door D at that time is the closed position. The back surface of the door D is abutted against an inner link 4, which will be described later, of the hinge 1, thereby the range of turning of the door D in the direction (closing direction) as indicated by the arrow Y is restricted as shown in FIG. 2, and the rotational position of the door D at that time is the closed position.

The hinge 1 includes a skeleton side attaching member 2 and a door side attaching member 3. The skeleton side attaching member 2, as shown in FIG. 3, has a horizontal U-shaped configuration in section, which has a pair of mutually opposing side plate parts 21, 21, and a connecting plate part 22 integrally formed between one sides of the pair of side plate parts 21, 21 in such a manner as to be orthogonal thereto. The skeleton side attaching member 2 is attached to the side plate part of the skeleton B in a state in which the skeleton side attaching member 2 is lengthwise oriented in the back and forth direction, the side plate part 21 is oriented in the up and down direction, and the opening part is opposed to the inner surface of the side plate part of the skeleton B. On the other hand, the door side attaching member 3 has a cup-shaped configuration of a shallow depth and is attached to the back surface of the door D. The door side attaching member 3 is connected to the skeleton side attaching member 2 so as to be able to turn in the directions as indicated by the arrows X and Y, through the inner link (selected link) 4 and the outer link (the other link) 5, respectively.

Figure 3:
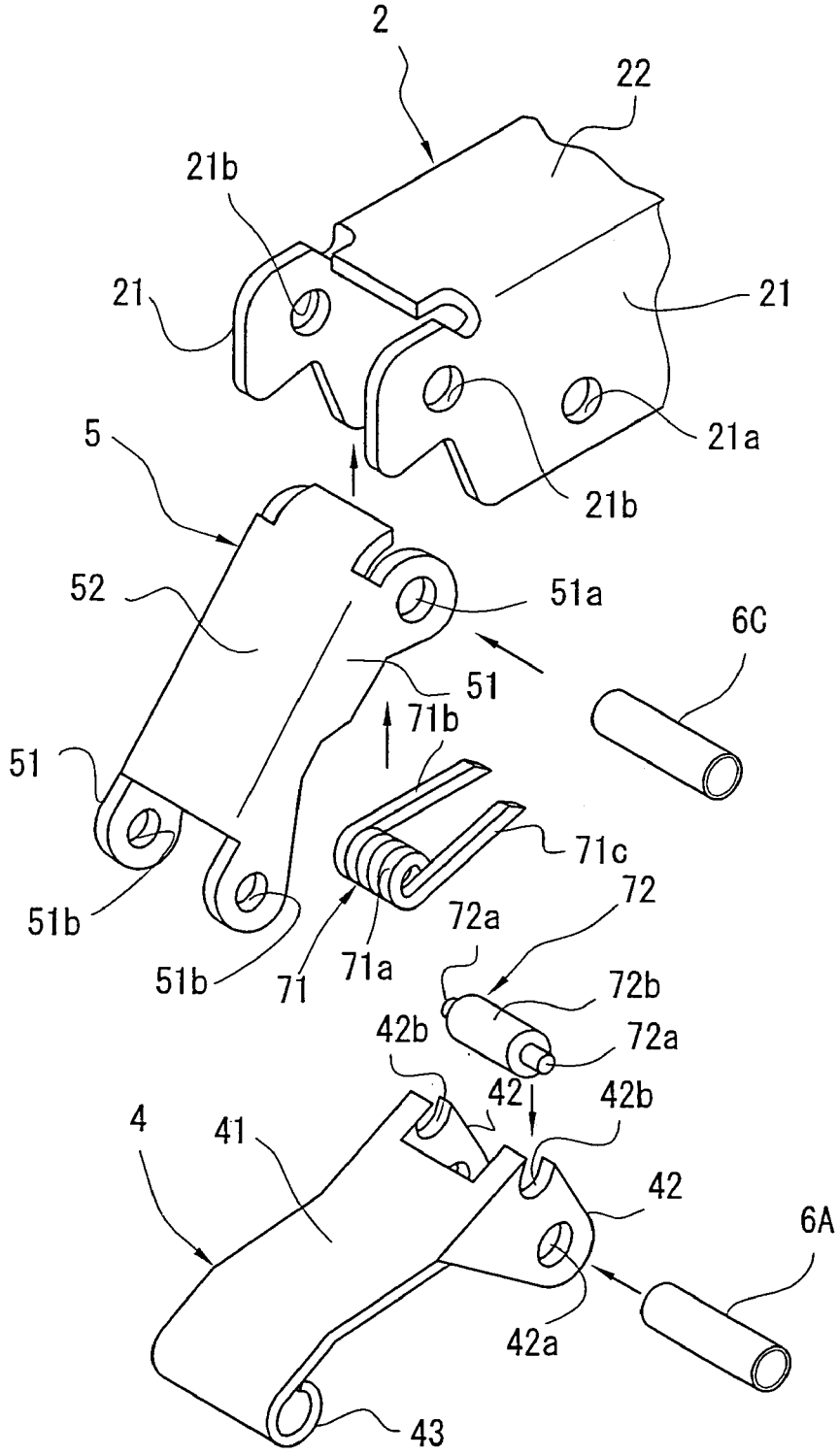
FIG. 3 is an exploded perspective view showing, partly omitted, a hinge with catch according to the present invention.

As shown in FIG. 3, the inner link 4 includes a base plate part 41. The base plate part 41 is provided at opposite sides of one end (end on the side of the skeleton side attaching member 2) with a pair of projection elements 42, 42 which are generally orthogonal to the base plate part 41 and integral with the base plate part 41. The projection elements 42, 42 are inserted in the side plate parts 21, 21 of the skeleton side attaching member 2 in such a manner as to oppose to front ends of the side plate parts 21, 21. A through-hole 42*a* is formed in each projection element part 42. A support hole 21*a* is formed in a front end of the side plate part 21 opposing the corresponding through-hole 42*a*. A first support shaft 6A is inserted in the support holes 21*a*, 21*a* and the through-holes 42*a*, 42*a*. Through this first support shaft 6A, the projection elements 42, 42 are connected to the side plate parts 21, 21 so as to be able to turn in the horizontal direction. Owing to this arrangement, the inner link 4 is supported by the skeleton side attaching member 2 so as to be able to turn in the horizontal direction. A bearing part 43 is formed on the other end of the base plate part 41 of the inner link 4 by being circularly wound around the other end of the base plate part 41. This bearing part 43, as shown in FIGS. 1 and 2, is connected to the opening part side end of the door side attaching member 3 so as to be able to turn in the horizontal direction, through a second support shaft 6B which is inserted in the bearing part 43.

The outer link 5, as shown in FIG. 3, is disposed more forwardly of the skeleton B than the inner link 4. The outer link 5 has a horizontal U-shaped configuration in section. The outer link 5 comprises a pair of mutually opposing side wall parts 51, 51, and a connecting wall part 52 integrally formed between one sides of the side wall parts 51, 51 in such a manner as to be orthogonal thereto. One ends of the pair of side wall parts 51, 51 are inserted in the side plate parts 21, 21 of the skeleton side attaching member 2 in such a manner as to be opposed to the front ends of the side plate parts 21, 21. A through-hole 51*a* is formed in one end of each side wall part 51 which is inserted between the side plate parts 21, 21. A support hole 21*b* is formed in a forward end of each side plate part 21 of the side wall part 51 which is opposed to the through-hole 51*a*. This support hole 21*b* is disposed more forwardly than the support hole 21*a* into which the first support shaft 6A is inserted. A third support shaft (support shaft) 6C is inserted in the support holes 21*b*, 21*b* and the through-holes 51*a*, 51*a*. By this, one end of the outer link 5 is connected at a place of the skeleton side attaching member more on the forward end side than the inner link 4 to the skeleton side attaching member 2 so as to be able to turn in the horizontal direction. A through-hole 51*b* is formed in the other end of each side wall part 51. The through-hole 51*b* is arranged more on the bottom side of the door side attaching member 3 than the second support shaft 6B. A fourth support shaft 6D is inserted in the through-holes 51*b*, 51*b*. Through this fourth support shaft 6D, the other end of each side wall part 51 is connected to the door side attaching member 3 so as to be able to turn in the horizontal direction.

A catch mechanism 7 is disposed at the hinge 1. The catch mechanism 7 includes a coiled spring (biasing means) 71 which is disposed at the outer link 5, and an abutment shaft (abutment member) 72 which is disposed at the inner link 4.

The coiled spring 71 is formed of a steel-made rod material having a regular square configuration, a circular configuration or the like in section. The coiled spring 71 includes a coil part 71*a* formed by winding the rod material with a coil, and a first and a second abutment part 71*b*, 71*c* projecting outward from the opposite ends of the coil part 71*a* along the tangential direction thereof. The coil part 71*a* is disposed between the pair of side wall parts 51, 51 and externally inserted in the third support shaft 6C. The coil part 71*a* may be inserted in any other shaft than the third support shaft 6C. However, by externally inserting the coil part 71*a* in the third support shaft 6C, the other shaft can be eliminated and the number of parts can be reduced to that extent. In addition, the hinge 1 can be miniaturized. The first abutment member 71*b* is in abutment with the connecting plate part 22 of the skeleton side attaching member 2. The second abutment member 71*c* is in abutment with the abutment shaft 72.

A cutout recess 42*b* is formed in each projection element 42 of the inner link 4. This cutout recess 42*b* is disposed at an intermediate part between the first support shaft 6A and the third support shaft 6C, such that an opening part of the cutout recess 42*b* faces the third support shaft 6C side and a bottom part thereof faces the first support shaft 6A side. The width of the cutout recess 42*b* is constant from its opening part to its bottom part. The bottom part of the cutout recess 42*b* is in the shape of a semi-circle which serves the width of the cutout recess 42*b* as the diameter of the semi-circle.

The abutment shaft 72, as shown in FIG. 3, is formed as a shaft member having a circular configuration in section. The abutment shaft 72 includes fitting shaft parts 72*a*, 72*a* formed on opposite ends thereof and an enlarged-diameter part (first and second stopper parts) 72*b*. The fitting shaft parts 72*a*, 72*a* and the enlarged-diameter part 72*b* are coaxially formed. The outside diameter of the fitting shaft part 72*a* is generally same as the width of the cutout recess 42*b*. The fitting shaft part 72*a* is inserted into the cutout recess 42*b* through the opening part of the cutout recess 42*b* and turnably fitting to the bottom part of the cutout recess 42*b*. By this, the abutment shaft 72 is turnably supported by the inner link 4. In this state, the abutment shaft 72 is parallel to the first through fourth support shafts 6A through 6D. The outside diameter of the enlarged-diameter part 72*b* is larger than the diameter of the fitting shaft part 72*a*. The entire length of the enlarged-diameter part 72*b* is generally same as the interval between the pair of projection elements 42, 42. Accordingly, when the abutment shaft 72 tries to move in its axial direction, the opposite end faces of the enlarged-diameter part 72*b* are abutted with the mutually opposing surfaces of the projection elements 42, 42. By this, the abutment shaft 72 is prevented from moving in the axial direction, and the abutment shaft 72 is prohibited from escaping in the axial direction of the abutment shaft 72 through the space between the pair of projection elements 42, 42. As apparent from the foregoing, in the hinge 1 according to this embodiment, the enlarged-diameter part 72*b* is used as the first and second stoppers. Instead of the enlarged-diameter part 72*b*, it is also accepted that two annular projections are spacedly disposed in the axial direction of the abutment shaft 72 as the first and second stoppers, and the annular projections are abutted with the mutually opposing surfaces of the projection elements 42, 42, respectively.

The second abutment part 71*c* of the coiled spring 71 is in abutment with the outer peripheral surface of the enlarged-diameter part 72*b* of the abutment shaft 72. Accordingly, the abutment shaft 72 is biased by the coiled spring 71. The direction for the coiled spring 71 to bias the abutment shaft 72 is coincident with the direction from the opening part side towards the bottom part of the cutout recess 42*b* irrespective of the turning position of the door D from the closed position to the open position. Owing to this arrangement, the abutment shaft 72 can be prohibited from escaping outside from the cutout recess 42*b* through its opening part.

The biasing force of the coiled spring 71 acts on the inner link 4 through the abutment shaft 72. By this biasing force, the inner link 4 is biased to turn about the first support shaft 6A and thus, the door D is biased to turn. When door D is located in a position offset towards the closed position from a predetermined neutral position between the closed position and the open position, the biasing force of the coiled spring 71 acts in direction towards the closed position side from the open position side (the direction as indicated by an arrow X of FIGS. 1 and 2). Accordingly, the door D is turningly moved to the closed position by the biasing force of the coiled sprint 71 so as to be abutted with the skeleton B and maintained in the closed position. On the other hand, when door D is located in a position offset towards the open position from the predetermined neutral position, the biasing force of the coiled spring 71 acts in direction towards the open position side from the closed position side (the direction as indicated by an arrow Y of FIGS. 1 and 2). Accordingly, the door D is turningly moved to the open position by the biasing force of the coiled sprint 71 so as to be abutted with the inner link 4 and maintained in the open position. When the door D is located in the neutral position, the acting line of the biasing force of the coiled spring 71 is intersected with the center line of the first support shaft 6A. Accordingly, when the door D is located in the neutral position, the biasing force of the coiled spring 71 never acts as a rotational biasing force for turning the door D.

In the hinge 1 with catch thus constructed, when the door D is turned in the opening/closing direction, the inner link 4 is turned. As the inner link 4 is turned, the abutment shaft 72 is moved in the longitudinal direction of the second abutment part 71*c* while being contacted with the second abutment part 71*c* of the coiled spring 71. At that time, the abutment shaft 72, which is turnable, comes into rolling contact, instead of sliding contact, with the second abutment part 71*c*. Accordingly, quick wearing of the abutment shaft 72 can be prevented.

At the time for mounting the abutment shaft 72 on the inner link 4, the fitting shaft parts 72*a*, 72*a* formed on the opposite ends of the abutment shaft 72 may simply be inserted in the cutout recesses 42*b*, 42*b* through the opening parts, respectively. Accordingly, the abutment shaft 72 can easily be mounted on the inner link 4 compared with the conventional hinge in which the abutment shaft must be inserted into the two support holes from one of the support holes to the other hole. Moreover, since the abutment shaft 72 is normally biased towards the bottom part side from the opening part side of the cutout recess 42*b* by the coiled spring 71, it never escapes to the outside from the cutout recess 42*b* through the opening part. Accordingly, there is no need for blocking the opening part of the cutout recess 42*b*.

It should be noted that the present invention is not limited to the above embodiment but that many changes and modifications can be made in accordance with necessity.

For example, in the above-mentioned embodiment, although the inner link 4 is provided with the abutment shaft (abutment member) 72 and the coiled spring 71 is mounted on the third support shaft 6C for turnably connecting the outer link 5 to the skeleton side attaching member 2, it is also accepted that the abutment shaft 72 is turnably disposed at the outer link 5 and the coiled spring 71 is mounted on the first support shaft 6A which turnably connects the inner link 4 to the skeleton side attaching member 2. It is also accepted that the coiled spring 71 is mounted on the first support shaft 6A, and the inner link 4 is provided with the abutment shaft 72, or otherwise, the coiled spring 71 is mounted on the third support shaft 6C and the outer link 5 is provided with the abutment shaft 72. However, in case the third support shaft 6C is provided with the coiled spring 71 and the inner link 4 is provided with the abutment shaft 72 as in this embodiment, the first and second abutment parts 71*b*, 71*b* of the coiled spring 71 can be projected backward on the side same side of the skeleton side attaching member 2 from the coil part 71*a*. Owing to this arrangement, the hinge 1 can be miniaturized.

Moreover, in the above-mentioned embodiment, when the door D is located in a position offset to the closed position side from the neutral position, the coiled spring 71 rotationally biases the door D towards the closed position side from the open position side, and when the door D is located in a position offset to the open position side from the neutral position, the coiled spring 71 rotationally biases the door D to the open position side from the closed position side. However, it may be designed such the coiled spring 71 normally biases the door D towards the closed position side irrespective of the rotational position of the door D.

Moreover, in the above-mentioned embodiment, although the entire abutment shaft 72 is integrally formed, it is also accepted that the abutment shaft comprises a shaft part opposite ends of which can be inserted into the cutout recesses 42*b*, 42*b* from the opening parts to the bottom parts thereof, and a cylindrical part turnably fitted to the outer periphery of the shaft part, and the second abutment part 71*c* of the coiled spring 71 is abutted with the outer peripheral surface of the cylindrical part.

Moreover, in the above-mentioned embodiment, although the coiled spring 71 is used as the biasing means, a plate spring may be used instead of the coiled spring 71.

INDUSTRIAL APPLICABILITY

The hinge with catch according to the present invention can be utilized as a hinge for turnably connecting a skeleton of furniture or the like and a door together.

The invention claimed is:

1. A hinge with catch comprising a skeleton side attaching member which can be attached to a skeleton; a door side attaching member which can be attached to a door; an inner and an outer link whose opposite ends are turnably connected to said skeleton side attaching member and said door side attaching member, respectively, so that said door side attaching member is turnably connected to said skeleton side attaching member between a closed position and an open position; an abutment member disposed generally in parallel relation to rotation axes of said inner and outer links and opposite ends of said abutment member are turnably supported by selected one of said inner and outer links; and biasing means for turnably biasing said door side attaching member through said abutment member and said selected link, by one end of said biasing means which is in abutment with said skeleton side attaching member and the other end thereof which is in abutment with an outer peripheral surface of said abutment member, wherein said abutment member is formed as a shaft and includes an enlarged-diameter part having a circular cross section and fitting shaft parts having a circular cross section, the outside diameter of said fitting shaft parts being smaller than that of said enlarged-diameter part, said fitting shaft parts formed coaxially on said enlarged-diameter part;

said selected link is provided at opposite sides thereof in the direction of the rotation axis with one pair of projection pieces which are placed in opposing relation in the direction of the axis of said abutment member;

each of said projection pieces is provided with a cutout recess respectively, said cutout recess being formed such that said fitting shaft parts of said abutment member can be turnably inserted into said recesses through open parts thereof until reach bottom parts of said cutout recesses;

said fitting shaft parts are pressed against said bottom parts of said cutout recesses by biasing force of said biasing means; and, opposite end faces of said enlarged-diameter part of said abutment member are abutted with said pair of projection pieces, thereby said abutment member is prohibited from escaping in the axial direction thereof through said cutout recesses.

2. A hinge with catch according to claim 1, wherein said cutout recesses are disposed between the rotation axes of said inner and outer links with respect to said skeleton side attaching member.

3. A hinge with catch according to claim 1, wherein said biasing means includes a coil part formed by spirally winding a rod material with a coil, and a first and a second abutment parts projecting to the outside from opposite ends of said coil part;

said coil part is externally mounted on or around a support shaft for turnably connecting one end of said inner link to said skeleton side attaching member or a support shaft for turnably connecting one end of said outer link to said skeleton side attaching member; and said first abutment part is abutted with said skeleton side attaching member while said second abutment part is abutted with said enlarged-diameter part of said abutment member.

4. A hinge with catch according to claim 2, wherein said biasing means includes a coil part formed by spirally winding a rod material with a coil, and a first and a second abutment parts projecting to the outside from opposite ends of said coil part;

said coil part is externally mounted on or around a support shaft for turnably connecting one end of said inner link to said skeleton side attaching member or a support shaft for turnably connecting one end of said outer link to said skeleton side attaching member; and said first abutment part is abutted with said skeleton side attaching member while said second abutment part is abutted with said enlarged-diameter part of said abutment member.

5. A hinge with catch according to claim 3, wherein said coil part is externally mounted on or around said support shaft for turnably connecting said one end of said outer link to said skeleton side attaching member, and said cutout recesses are provided at said inner link.

6. A hinge with catch according to claim 4, wherein said coil part is externally mounted on or around said support shaft for turnably connecting said one end of said outer link to said skeleton side attaching member, and said cutout recesses are provided at said inner link.

* * * * *

UNITED STATES PATENT AND TRADEMARK OFFICE

CERTIFICATE OF CORRECTION

PATENT NO. : 7,059,018 B2
APPLICATION NO. : 10/470697
DATED : June 13, 2006
INVENTOR(S) : Koshikawa et al.

It is certified that error appears in the above-identified patent and that said Letters Patent is hereby corrected as shown below:

Column 7, line 46: after “enlarged-diameter part” the phrase --at opposite end faces of said enlarged-diameter part-- should be added Column 7, line 54: --cutout-- should be inserted between “said” and “recesses”

Column 7, line 55: --they-- should be inserted between “until” and “reach”

Signed and Sealed this

Fourteenth Day of November, 2006

JON W. DUDAS
*Director of the United States Patent and Trademark Office*